United States Patent [19]

Gehring et al.

[11] Patent Number: 5,031,411

[45] Date of Patent: Jul. 16, 1991

[54] EFFICIENT DEHUMIDIFICATION SYSTEM

[75] Inventors: Kenneth C. Gehring, Cottage Grove; Joel C. Zabel; Phillip R. Steinmetz, both of Madison, all of Wis.

[73] Assignee: DEC International, Inc., Madison, Wis.

[21] Appl. No.: 514,528

[22] Filed: Apr. 26, 1990

[51] Int. Cl.[5] ..... F25D 17/06

[52] U.S. Cl. ..... 62/93; 62/525; 62/526

[58] Field of Search ..... 62/524, 525, 526, 93, 62/272, 277

[56] References Cited

U.S. PATENT DOCUMENTS 4,428,205 1/1984 Doderer .
4,607,498 8/1986 Dinh .
4,665,712 5/1987 Gehring et al. ..... 62/526

FOREIGN PATENT DOCUMENTS 0311086 12/1988 Japan ..... 62/93
0311087 12/1988 Japan ..... 62/93

*Primary Examiner*—Albert J. Makay
*Assistant Examiner*—John Sollecito
*Attorney, Agent, or Firm*—Andrus, Sceales, Starke & Sawall

[57] ABSTRACT

Efficient dehumidification is provided by directing air flow through a coil (30, 60) to cool the air below the dew point such that water vapor in the air is condensed to liquid to dehumidify the air, and then directing air flow through the coil to heat the air to a temperature below the incoming air to the coil and above the dew point of the air. Air flow is directed along a first set of coil sections (42, 64) giving up heat to refrigerant in the first set of coil sections to evaporate refrigerant in the first set of coil sections, and then directing the air flow along a second set of coil sections (44, 66) absorbing heat from refrigerant in the second set of coil sections to condense refrigerant in the second set of coil sections. The coil sections are connected to alternately evaporate and condense refrigerant in the coil differentially such that less refrigerant is condensed in condensing coil sections than is evaporated in evaporating coil sections. Heat is transferred from air flow along a first air flow path leg (48, 72) through the evaporating coil sections (42, 64) to air flow along a second air flow path leg (50, 74) through the condensing coil sections (44, 66) through the media of the refrigerant, to put heat back into the air flow along the second air flow path leg from the first air flow path leg, reducing the net cooling effect of the coil, to reduce the net load on the compressor by the coil such that the compressor will consume power based on the net cooling load, while the coil provides the greater cooling capacity of the evaporating coil sections (42, 64), which allows more moisture to be condensed from the air with less energy.

46 Claims, 9 Drawing Sheets

REFRIGERANT-22 PRESSURE-ENTHALPY DIAGRAM

TEMPERATURE IN ° FAHRENHEIT

VOLUME IN cu ft/lb

ENTROPY IN BTU/lb°R

QUALITY IN WT %

REFRIGERANT-22 PRESSURE-ENTHALPY DIAGRAM

TEMPERATURE IN ° FAHRENHEIT

VOLUME IN cu ft/lb

ENTROPY IN BTU/lb°R

QUALITY IN WT %

EFFICIENT DEHUMIDIFICATION SYSTEM

BACKGROUND AND SUMMARY

The invention relates to dehumidifier systems, and more particularly to methods and apparatus for improved efficiency.

Dehumidifier systems are known in the prior art. A compressor delivers hot compressed refrigerant gas. A condenser receives the refrigerant gas and condenses same to hot refrigerant liquid. An expansion device receives the refrigerant liquid from the condenser and expands same to drop the temperature and pressure of the liquid. An evaporator receives the cool liquid refrigerant from the expansion device and evaporates same to cold gas refrigerant, which is returned to the compressor to complete the refrigeration cycle. Air flow is directed across the evaporator to cool the air below the dew point such that water vapor in the air is condensed to liquid to dehumidify the air. The dehumidified air is then directed across the condenser to warm the air. A typical prior art dehumidifier will yield about 2 to 3.5 pints of water from the air per kilowatt hour of electricity used by the compressor.

The present invention yields about 5 pints of water from the air per kilowatt hour of electricity used by the compressor, providing a significant increase in efficiency. This is accomplished in the present invention by reducing the net cooling effect of an evaporator coil, to reduce the net load on the compressor such that the compressor will consume power based on the net cooling load, while providing the coil with some sections of greater cooling capacity, which allows more moisture to be condensed from the air with less energy.

DETAILED DESCRIPTION

Figure 1:
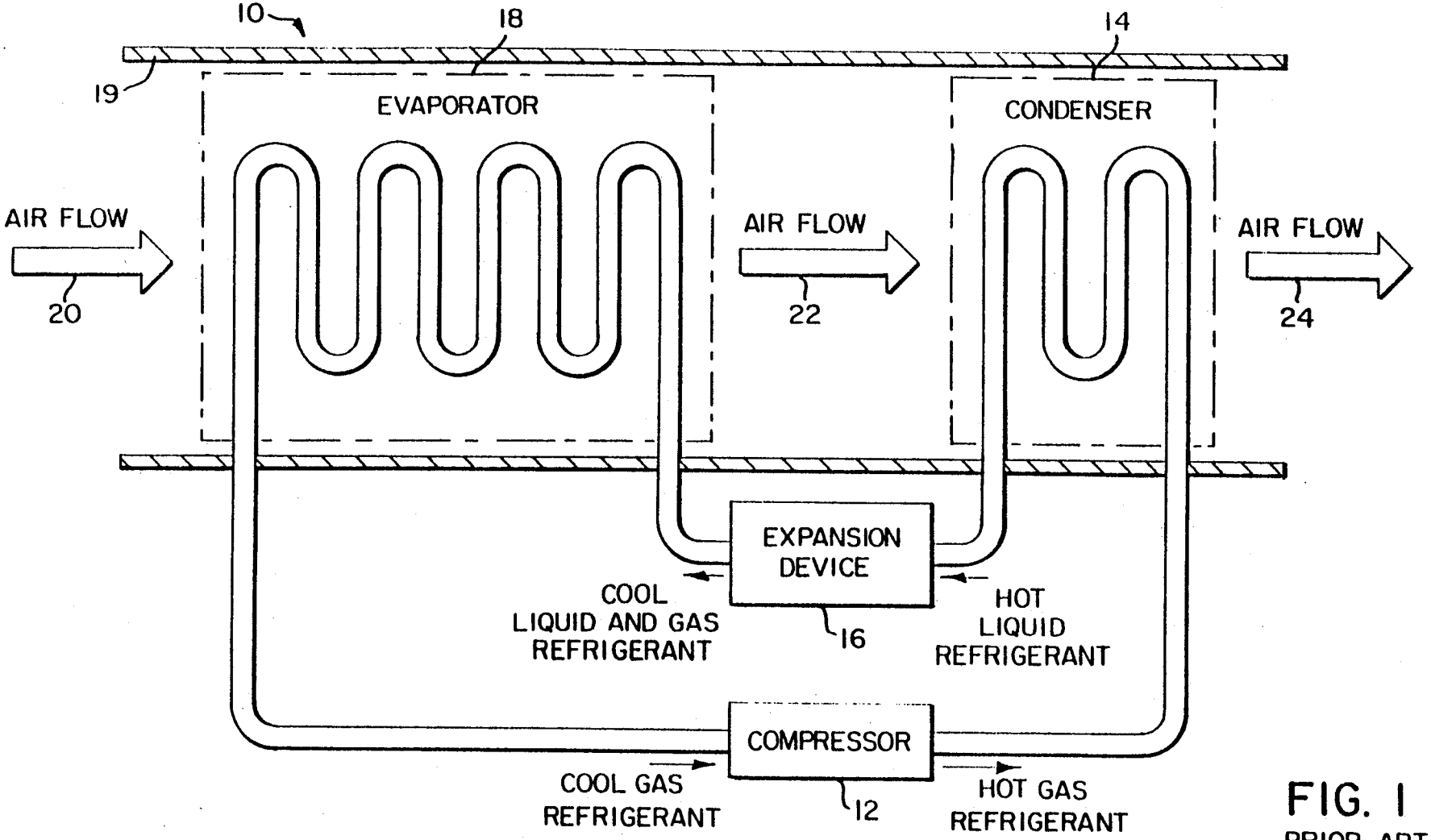
FIG. 1 PRIOR ART
FIG. 1 shows a dehumidifier known in the prior art.

FIG. 1 shows a dehumidifier 10 known in the prior art. A compressor 12 delivers compressed hot gas refrigerant. A condenser 14 receives the hot gas refrigerant and condenses same to hot liquid refrigerant, and gives up heat to the air flow therethrough. An expansion device 16 receives the hot liquid refrigerant and expands same to a liquid and gas refrigerant mixture of reduced temperature and pressure. Expansion device 16 is typically a flow restrictor, capillary tube, or other pressure reducer. An evaporator 18 receives the cool liquid and gas refrigerant mixture and evaporates the liquid portion to cool gas refrigerant, and absorbs heat from the air flow therethrough. The refrigerant is circulated from compressor 12 to condenser 14 to expansion device 16 to evaporator 18 and back to compressor 12 in a refrigeration cycle. Air flow, typically driven by a fan (not shown), is directed by a duct or housing 19 along a path through evaporator 18 and condenser 14. As the air flows through evaporator 18 from point 20 to point 22, the temperature of the air drops below the dew point such that water vapor in the air is condensed to liquid to dehumidify the air. The air is heated as it flows through condenser 14 from point 22 to point 24, and the warmed and dehumidified air is discharged to the desired space, such as a basement, or other interior space of a house or building.

Figure 2:
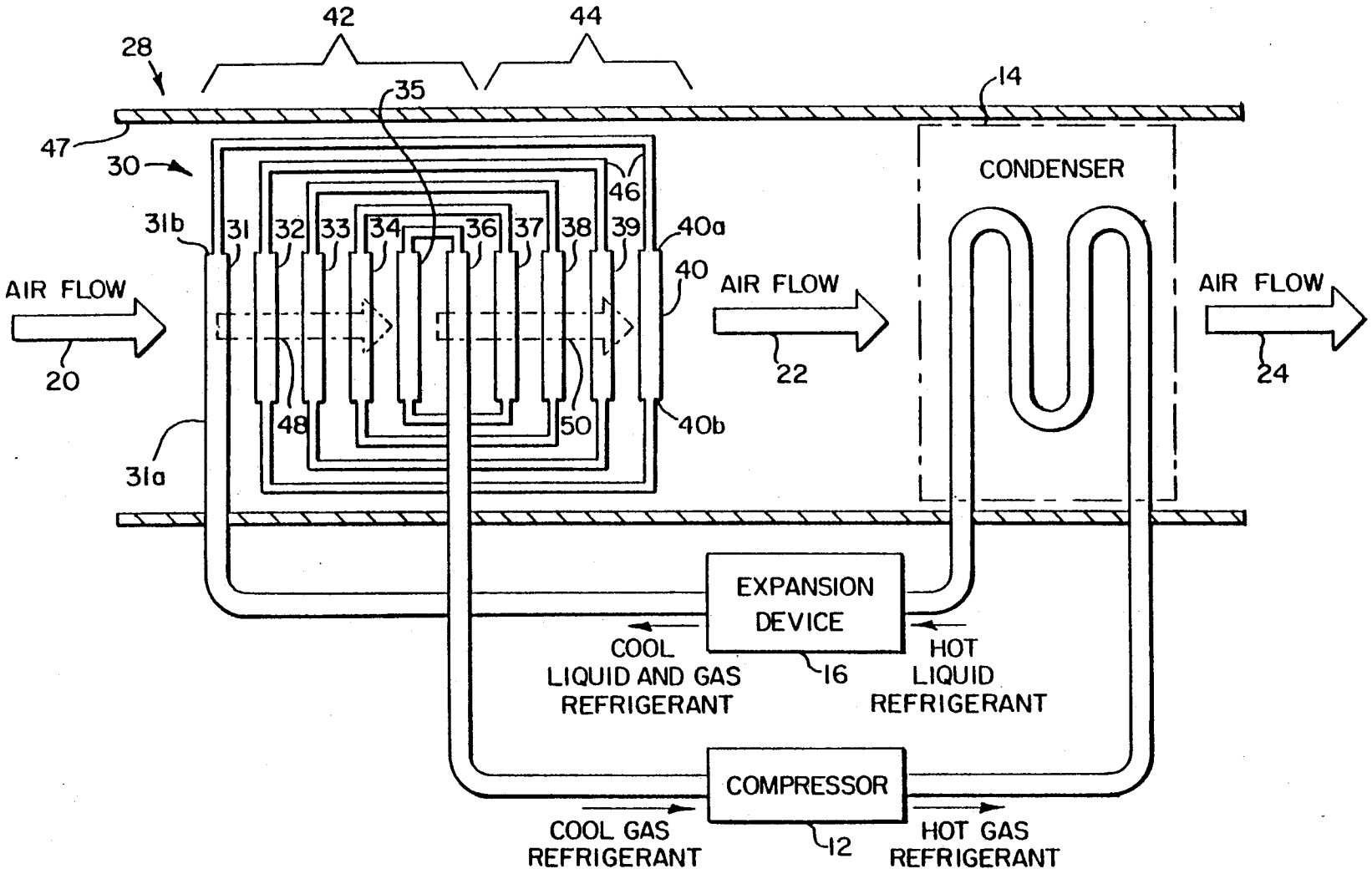
FIG. 2 shows a dehumidifier in accordance with the present invention.

FIG. 2 shows a dehumidifier 18 in accordance with the present invention, and uses like reference numerals from FIG. 1 where appropriate to facilitate understanding. A coil 30 has a plurality of serially connected coil sections 31 through 40 comprising first and second sets 42 and 44. Coil section 31 is the coil inlet and receives refrigerant from expansion device 16. Coil section 36 is the coil outlet and delivers refrigerant to compressor 12. Coil outlet 36 is of lower temperature than coil inlet 31. The refrigerant is circulated through the serially connected coil sections by circulating refrigerant through the first coil section 31 of the first set 42, then through the first coil section 40 of the second set 44, then through the second coil section 32 of the first set 42, then through the second coil section 39 of the second set 44, then through the third coil section 33 of the first set 42, then through the third coil section 38 of the second set 44, and so on. The temperature and pressure of the refrigerant as it passes through coil 30 from inlet 31 to outlet 36 is reduced by the size of the tubing used for coil sections 31–40 and/or by restrictions between the coil sections, such as reduced interconnecting tubing as at 46.

Air flow from point 20 to point 22 is directed by duct 47 along a path having first and second legs 48 and 50 extending along coil 30. Air flow is directed along the first leg 48 along the first set 42 of coil sections 31–35, and then along the second leg 50 along the second set 44 of coil sections 36–40. Heat is transferred from air flowing along first leg 48 of the air flow path to refrigerant in the first set 42 of coil sections 31–35 such that the refrigerant absorbs heat from the air and evaporates to lower the temperature of the air below the dew point such that water vapor in the air is condensed to liquid to dehumidify the air. The refrigerant is circulated from the first set of coil sections to the second set of coil sections by circulating refrigerant from a coil section such as 31 of the first set 42 to the next serially connected respective coil section such as 40 of the second set 44, and then to coil section 32 of first set 42, and then to coil section 39 of second set 44, and so on. Heat from the refrigerant in the second set 44 of coil sections 36–40 is transferred to air flowing along the second leg 50 of the air flow path, such that heat is given up to the air and the refrigerant condenses, to raise the temperature of the air such that dehumidified and warmed air flows at 22 from the second leg 50 of the air flow path. Heat is transferred from air flow along the first leg 48 of the air flow path to air flow along the second leg 50 of the air flow path through the media of the refrigerant, to put heat back into the air flow along the second leg 50 from the air flow along the first leg 48, reducing the net cooling effect of coil 30, to reduce the net load on compressor 12 by coil 30 such that compressor 12 will consume power based on the net cooling load, while the coil provides the greater cooling capacity of sections 31 through 35, which allows more moisture to be condensed from the air with less energy.

Air flow is directed from point 20 along the first leg 48 of the air flow path by directing air flow across the first coil section 31 of the first set 42, then across second coil section 32 of first set 42, and so on until air flow crosses the last coil section 35 of first set 42. Air flow is then directed along second leg 50 of the air flow path by directing air flow across the last coil section 36 of second set 44, and then across the next to last coil section 37 of second set 44, and so on until air flow crosses the first coil section 40 of second set 44. Air flow along the path 48, 50 from point 20 to point 22 is thus initially directed across first coil section 31 of first set 42, and is lastly directed across first coil section 40 of second set 44. It is preferred that the coil inlet be the first coil section 31 of first set 42, though the coil inlet may alternatively be the first coil section 40 of second set 44. It is preferred that the coil outlet be the last coil section 36 of second set 44, though an odd number of coil sections may be used and the coil outlet may be the last coil section of the first set.

In the embodiment in FIG. 2, the air flows through coil 30 from point 20 to point 22 in a straight-through path, wherein the first and second path legs 48 and 50 are rectilinearly aligned. The refrigerant is circulated in a path having multiple parallel runs 31–40 interconnected at their ends by tubing, such as 46, such that the outermost run 31 on one side of the coil is connected to the outermost run 40 on the other side of the coil, and the next to outermost run 32 on the one side of the coil is connected to the next to outermost run 39 on the other side of the coil, and so on. One of the outermost runs such as 31 is the coil inlet. A central run such as 36 is the coil outlet. Air flow from point 20 is directed along the first leg 48 of the air flow path along the first portion 42 of the coil from outermost run 31 to central run 36, and the air flow is then directed along the second leg 50 of the air flow path along the second portion 44 of the coil from central run 36 to outermost run 40. The air flow path direction, including along legs 48 and 50, is perpendicular to runs 31–40. The restricted interconnecting tubing such as 46 provides a plurality of expansion devices in the coil along the length thereof between coil inlet 31 and coil outlet 36 progressively expanding the refrigerant and progressively reducing refrigerant temperature. The dehumidified air at point 22 is directed through condenser 14 to provide warmed and dehumidified air at point 24.

Figure 3:
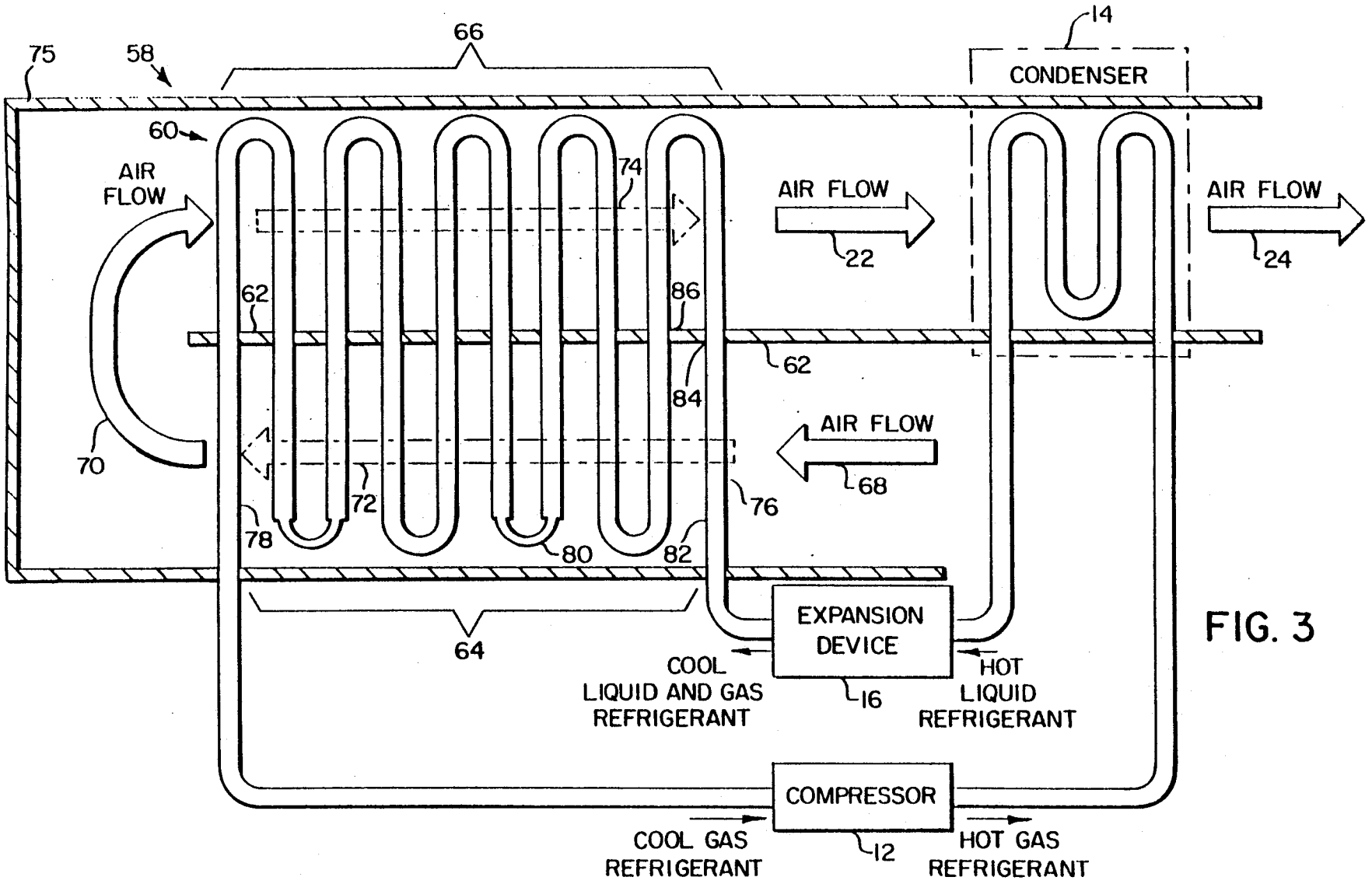
FIG. 3 shows an alternate embodiment of a dehumidifier in accordance with the present invention.

FIG. 3 shows an alternate embodiment dehumidifier 58, and uses like reference numerals from FIG. 2 where appropriate to facilitate understanding. Instead of the straight-through air flow path of FIG. 2, a loop-back air flow path is provided in FIG. 3. Coil 60 is a serpentine member having multiple straight runs and having at the end of each run a reverse bend leading to the next run. The coil has a central dividing wall 62 extending perpendicularly to the runs and dividing the coil into first and second portions 64 and 66. Air flow is directed in a loop-back path from point 68 to point 70 to point 22. The loop-back path has first and second legs 72 and 74. Air flow is directed leftwardly along first leg 72 along first portion 64 of the coil in a leftward direction from the right end of the coil to the left end of the coil to lower the temperature of the air below the dew point such that water vapor in the air is condensed to liquid to dehumidify the air. The air flow is then reversed at U-shape bend 70 at duct 75 at the left end of the coil. The air flow is then directed rightwardly along the second leg 74 of the air flow path along the second portion 66 of the coil in a rightward direction from the left end of the coil to the right end of the coil to raise the temperature of the air such that dehumidified and warmed air flows from second leg 74 of the air flow path at second coil portion 66 at the right end of the coil at point 22.

Heat is transferred from air flowing along first leg 72 to refrigerant in the first portion 64 of the coil. The refrigerant is circulated to the second portion 66 of the coil and transfers heat to air flowing along second leg 74 of the air flow path. Heat is thus transferred from air flow along first leg 72 to air flow along second leg 74 through the media of the refrigerant flowing through coil 60 from coil inlet 76 to coil outlet 78. Heat is put back into air flow along second leg 74 of the air flow path from first leg 72 of the air flow path, reducing the net energy requirements of coil 60, to reduce the net load on compressor 12 by coil 60 such that compressor 12 may drive the left end of the coil at outlet 78 to lower temperatures to cool more air below the dew point, without increased energy consumption by compressor 12. The air flow path, including first and second legs 72 and 74 and U-shape bend 70, and each run of coil 60 are all coplanar. The leftward air flow along leg 72 and the rightward air flow along leg 74 are parallel to each other and perpendicular to each of the coil runs. The dehumidified air at 22 is directed through condenser 14 to provide warmed and dehumidified air at point 24. A plurality of expansion devices in coil 60 along the length thereof between coil inlet 76 and coil outlet 78 progressively expand the refrigerant and progressively reduce refrigerant temperature and pressure. These expansion devices are provided by the size of the tubing for the coil runs and/or the reverse bends at the ends of the runs, and/or restrictors such as 80.

In one implementation, air flowing into the coil at 20 in FIG. 2, and at 68 in FIG. 3, had a temperature of 80° F. The air at the coil outlet 36 in FIG. 2, and 78 in FIG. 3, had a temperature of 50° F. The air leaving the coil at 22 had a temperature of 65° F. The refrigerant temperature entering the coil at inlet 31 in FIG. 2, and at inlet 76 in FIG. 3, had a temperature of 70° F., and the refrigerant leaving the coil at outlet 36 in FIG. 2, and at outlet 78 in FIG. 3, had a temperature of 45° F. The refrigerant entering the coil at inlet 31 in FIG. 2, and at 76 in FIG. 3, was about 90% liquid and about 10% gas. The refrigerant leaving the coil at outlet 36 in FIG. 2, and at 78 in FIG. 3, was about 100% gas. The refrigerant in the first coil section from point **31*a* to point 31*b* in FIG. 2, and from point 82 to 84 in FIG. 3, changed from 90% liquid and 10% gas to 88% liquid and 12% gas. The refrigerant in the first coil section 40 of the second set 44 from point 40*a* to point 40*b* in FIG. 2, and from point 84 to point 86 in FIG. 3, changed from 88% liquid and 12% gas to 89% liquid and 11% gas. Thus, in coil section 31 in FIG. 2, and 76 in FIG. 3, the refrigerant evaporates to lesser liquid and more gas, and then in coil section 40 in FIG. 2, and the coil section between points 84 and 86 in FIG. 3, the refrigerant condenses, but by a lesser amount. This evaporation followed by lesser condensation continues such that the coil 30 in FIG. 2, and 60 in FIG. 3, has a net evaporator effect, with the refrigerant at the coil outlet being 100% gas. The first portion 42 of coil 30 provided by coil sections 31–35 in air flow path leg 48 functions as an evaporator, while the second portion 44 of coil 30 provided by coil sections 36–40 in air flow path leg 50 functions as a condenser. Likewise in FIG. 3, coil portion 64 in air flow path leg 72 functions as an evaporator, and coil portion 66 in air flow path leg 74** functions as a condenser.

The arrangements shown in FIGS. 2 and 3 provided dehumidification of 5.1 pints of water per kilowatt hour of electricity, which is a significant improvement over the 2 to 3.5 pints per kilowatt hour encountered in prior art dehumidifiers of the form in FIG. 1. This improvement in efficiency is enabled by reducing the net cooling effect of coil 30, to reduce the net load on compressor 12 by coil 30 such that compressor 12 will consume power based on the net cooling load, while the coil provides the greater cooling capacity of sections 31–35, which allows more moisture to be condensed from the air with less energy.

In the above noted implementation, the evaporating portion 42 of coil 30 in FIG. 2, and evaporating portion 64 in FIG. 3, took about 10,000 BTUs of sensible and latent heat out of the air flow along the first leg 48 in FIG. 2, and 72 in FIG. 3, and condensing portion 44 of coil 30 in FIG. 2, and condensing portion 66 in FIG. 3, put back about 3,500 BTUs of heat into the air flow along leg 50 in FIG. 2, and 74 in FIG. 3. The compressor sees a net load of 6,500 BTUs, however 10,000 BTUs of heat is being absorbed from the air in the evaporator portion of the coil to cool more air below the dew point than otherwise possible if only 6,500 BTUs of heat were removed from the air.

The coil presents a net cooling load on the compressor represented by the enthalpy difference in air entering and leaving the coil. Air entering the coil is cooled down below the dew point such that water vapor in the air is condensed to liquid to dehumidify the air. The air flow is then directed through the coil to heat the air to a temperature below the incoming air to the coil and above the dew point of the air. The air entering the coil is thus cooled down below the dew point and then reheated before leaving the coil, such that the air leaving the coil has a lower temperature than the air entering the coil, and such that the air leaving the coil is dehumidified relative to the air entering the coil. Air flow is directed along a first set of coil sections, 42 in FIG. 2, and 64 in FIG. 3, giving up heat to refrigerant in the first set of coil sections to evaporate refrigerant in the first set of coil sections. The air flow is then directed along a second set of coil sections, 44 in FIG. 2, and 66 in FIG. 3, absorbing heat from refrigerant in the second set of coil sections to condense refrigerant in the second set of coil sections. Refrigerant in the coil is alternately evaporated and condensed differentially such that less refrigerant is condensed in the condensing coil sections, 44 in FIG. 2, and 66 in FIG. 3, than is evaporated in the evaporating coil sections, 42 in FIG. 2, and 64 in FIG. 3, such that the coil outlet has a higher percentage gas refrigerant than the coil inlet, and such that the coil outlet has a lower percentage liquid refrigerant than said coil inlet, and such that the coil outlet has a lower temperature than the coil inlet.

Figure 4:
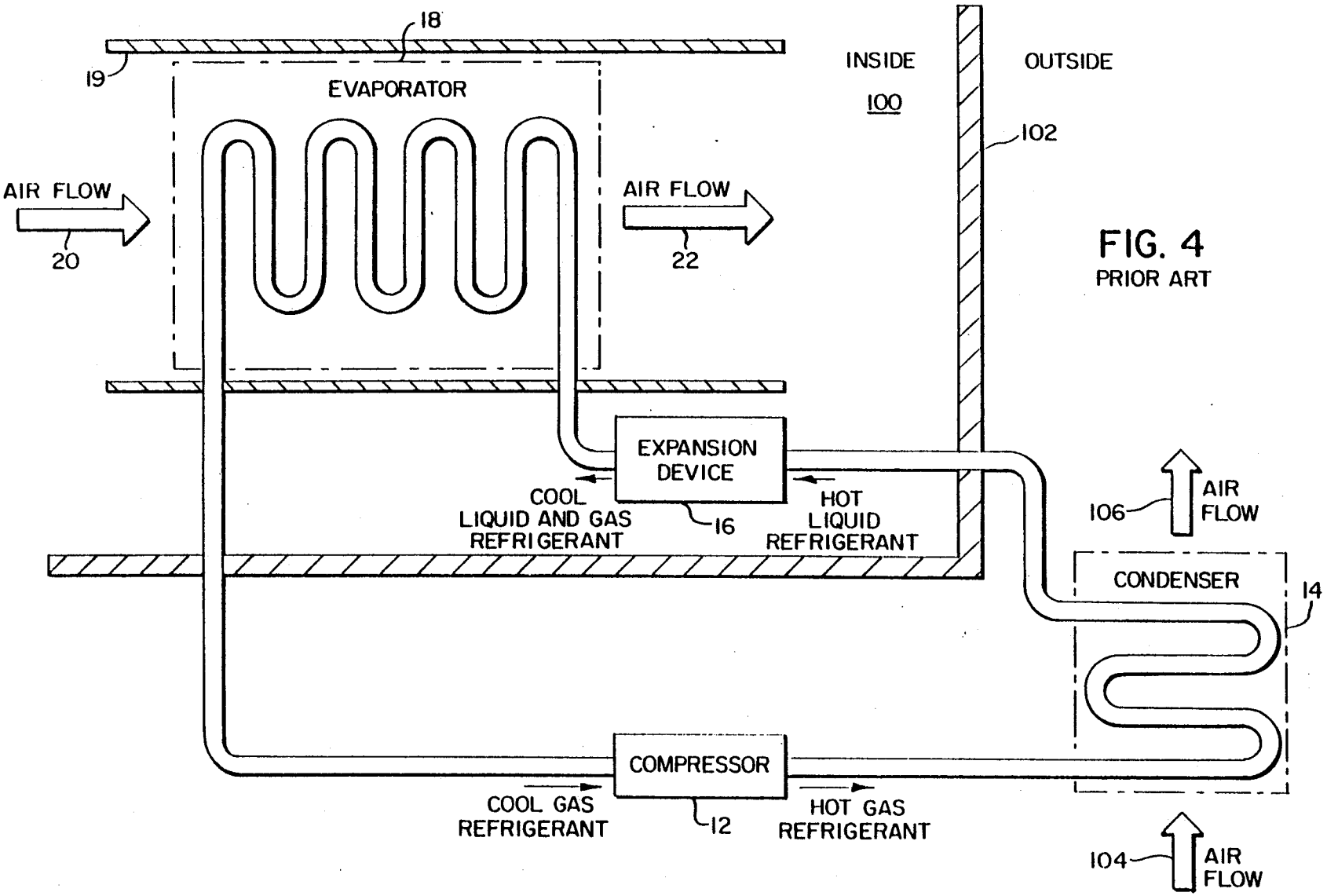
FIG. 4 PRIOR ART
FIG. 4 shows an air conditioner known in the prior art.

FIG. 4 shows an air conditioner and dehumidifier known in the prior art air conditioning and dehumidifying for an enclosed space 100 such as the inside of a building 102, and uses like reference numerals from FIG. 1 where appropriate to facilitate understanding. Condenser 14 and compressor 12 are outside the building, and expansion device 16 and evaporator 18 are inside the building. The air flow at 22 from evaporator coil 18 cools the inside of the building. Condenser 14 is outside the building and exterior to space 100 and exhausts heat given up by the refrigerant during condensing thereof. The heat is given up to air flow from point 104 to point 106.

Figure 5:
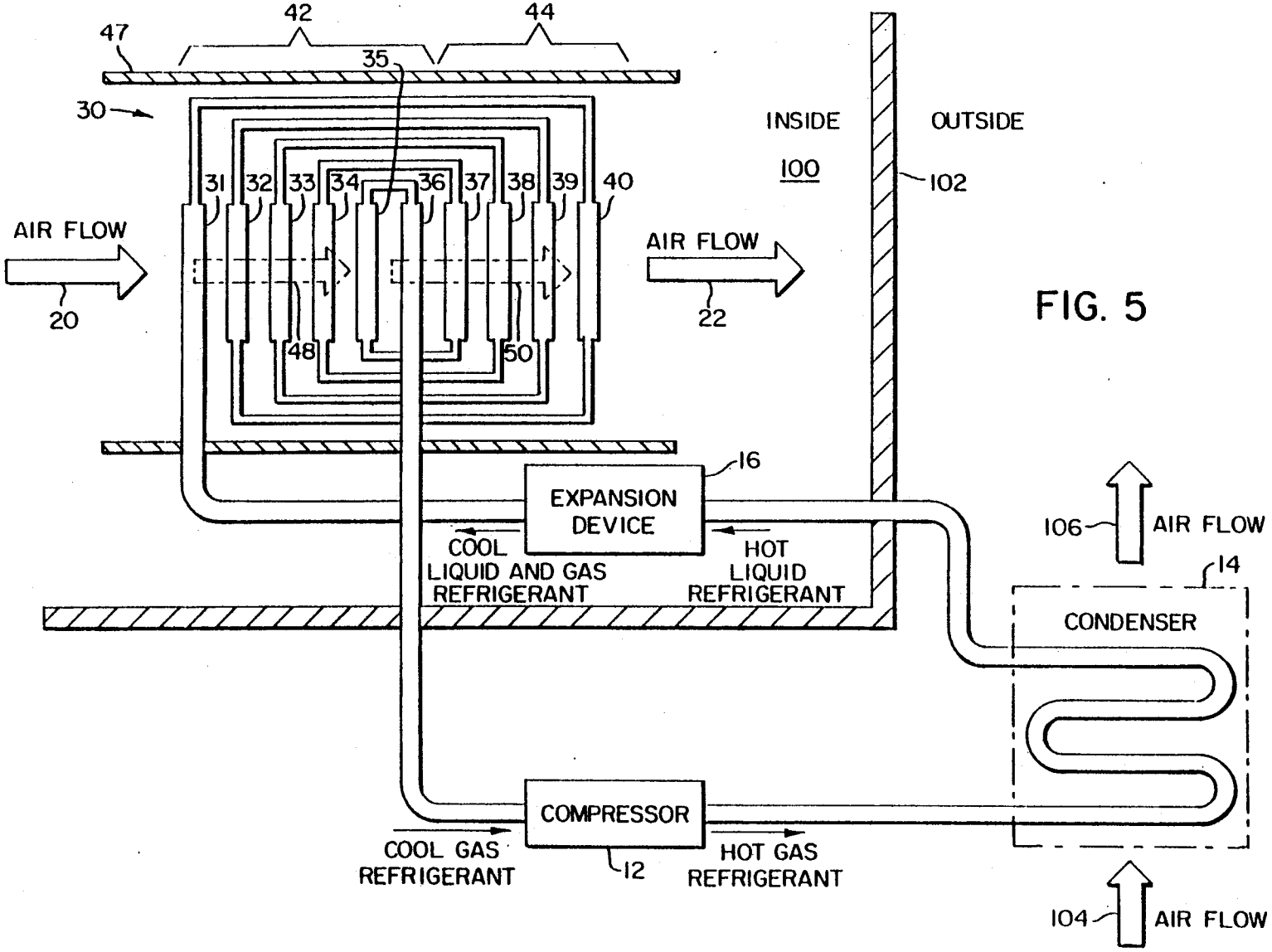
FIG. 5 shows an air conditioner in accordance with the present invention.

FIG. 5 shows an air conditioner and dehumidifier in accordance with the invention, and uses like reference numerals from FIGS. 2 and 4 where appropriate to facilitate understanding. Coil 30 is within space 100 for cooling the space.

Figure 6:
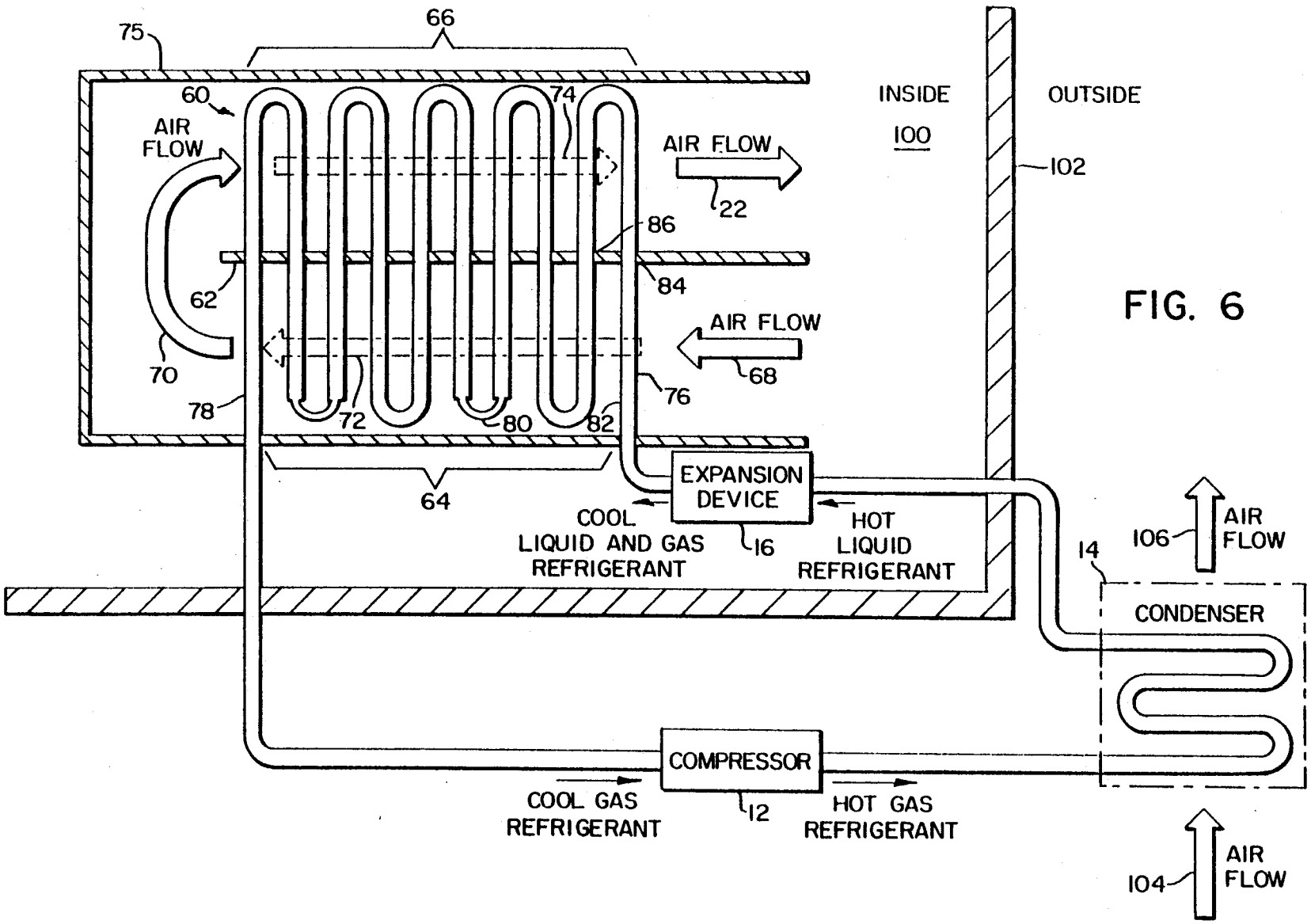
FIG. 6 shows an alternate embodiment of an air conditioner in accordance with the present invention.

FIG. 6 shows an alternate embodiment of an air conditioner and dehumidifier in accordance with the invention, and uses like reference numerals from FIGS. 3 and 4 where appropriate to facilitate understanding. Coil 60 is within space 100 for cooling such space.

Figure 7:
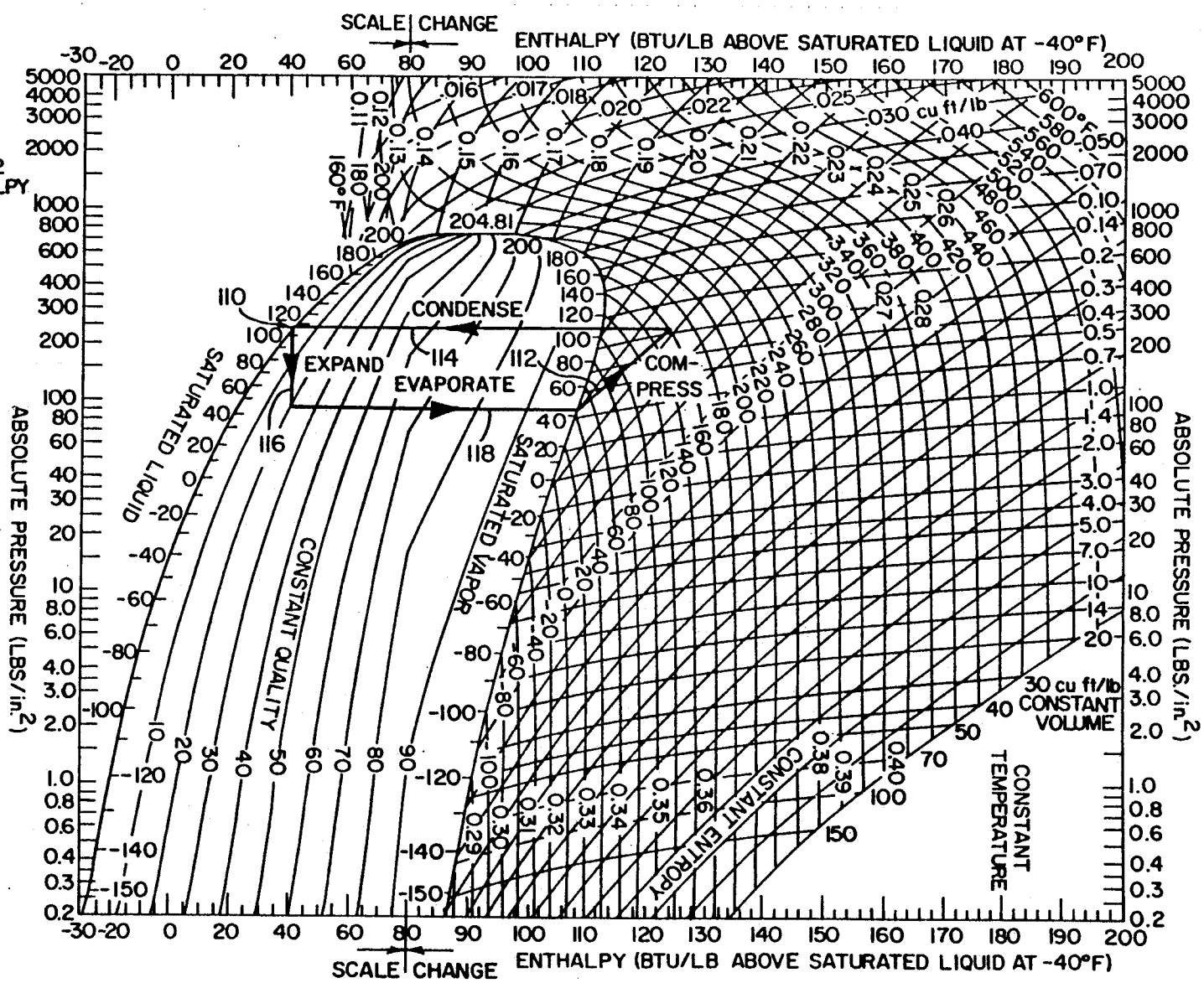
FIG. 7 PRIOR ART
FIG. 7 is a pressure-enthalpy diagram and shows a refrigeration cycle as known in the prior art.

FIG. 7 shows a refrigeration cycle 110 known in the prior art as provided by dehumidifier 10 in FIG. 1. The refrigerant is compressed at portion 112 of the cycle, condensed at portion 114, expanded at portion 116, and evaporated at portion 118.

Figure 8:
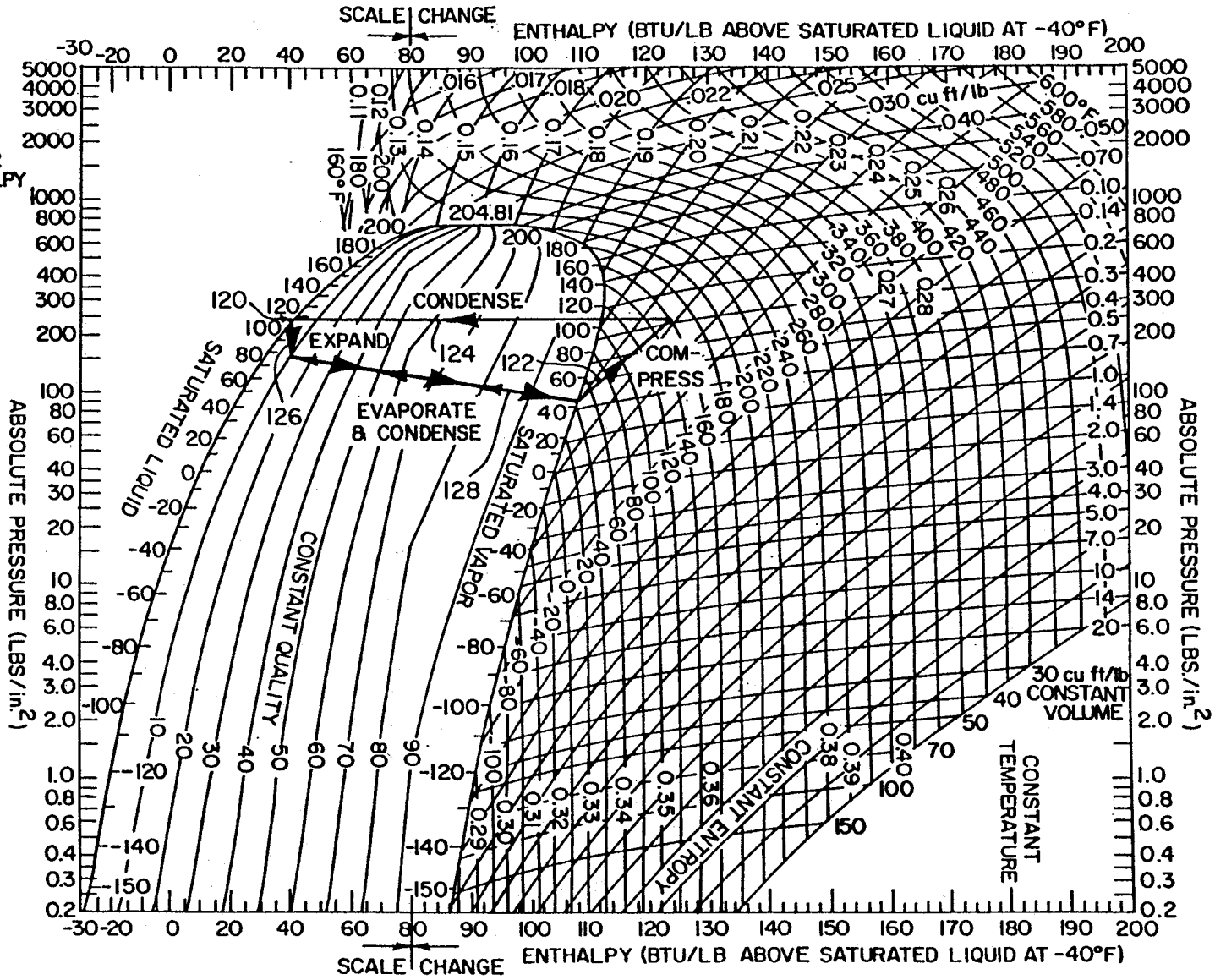
FIG. 8 is a pressure-enthalpy diagram and shows a refrigeration cycle in accordance with the present invention.

FIG. 8 is a pressure-enthalpy diagram as in FIG. 7, but showing the refrigeration cycle 120 in accordance with the present invention provided by dehumidifier 18, FIG. 2, and 58, FIG. 3. The refrigerant is compressed at portion 122 of the cycle, condensed at portion 124, expanded at portion 126, and evaporated at portion 128. Portion 128 includes evaporating segments 130, FIG. 9, and condensing segments 132. Evaporating segments 130 are provided by coil sections 31 through 35 in FIG. 2 providing the noted first coil portion 42. Condensing segments 132 are provided by coil sections 36 through 40 providing the noted second coil portion 44. In FIG. 3, evaporating segments 130 are provided by the coil sections in first coil portion 64, and condensing segments 132 are provided by the coil sections in second coil portion 66.

Figure 9:
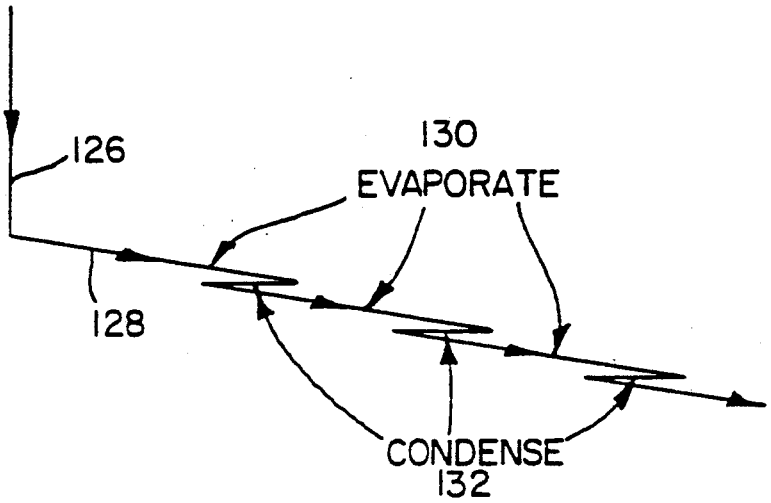
FIG. 9 is an enlarged portion of FIG. 8.
Figure 10:
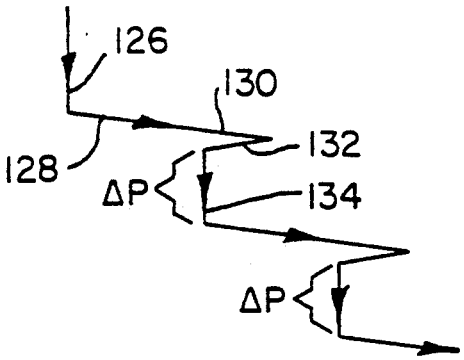
FIG. 10 is like FIG. 9 and shows a further embodiment.
Figure 11:
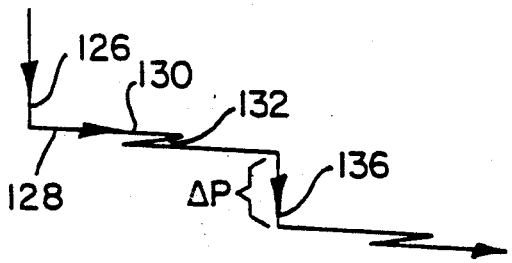
FIG. 11 is like FIG. 10 and shows a further embodiment.

FIG. 9 does not show pressure drops induced by restrictions other than the restriction of the coil tubing itself. If restrictions are provided, they can be placed anywhere in the coil. In FIG. 2, restrictions such as 46 are placed at the end of the condensing runs for maximum efficiency, and the resulting pressure drops $\Delta P$ are shown at 134 in FIG. 10. In FIG. 3, the restrictions such as 80 are placed in the middle of the evaporating or condensing sections and provide pressure drops $\Delta P$ as shown at 136 in FIG. 11.

It is recognized that various equivalents, alternatives and modifications are possible within the scope of the appended claims.

We claim:

1. A method for efficiently dehumidifying air comprising:

providing a compressor for delivering hot compressed refrigerant;

providing a condenser receiving refrigerant from said compressor and condensing same;

providing an expansion device receiving refrigerant from said condenser and expanding same;

providing a coil having an inlet receiving refrigerant from said expansion device and having an outlet delivering refrigerant to said compressor;

circulating refrigerant from said compressor to said condenser to said expansion device to said coil and back to said compressor in a refrigeration cycle;

directing air flow through said coil to cool the air below its dew point such that water vapor in the air is condensed to liquid to dehumidify the air, and then directing air flow through the coil to heat the air to a temperature below the incoming air to the coil and above the dew point of the air, such that the coil presents a net cooling load on the compressor represented by the enthalpy difference in air entering and leaving the coil, such that the air entering the coil is cooled below the dew point and then reheated before leaving the coil, such that the air leaving the coil has a lower temperature than the air entering the coil, and such that the air leaving the coil is dehumidified relative to the air entering the coil.

2. A method for efficiently dehumidifying air comprising:

providing a compressor for delivering hot compressed refrigerant;

providing a condenser receiving refrigerant from said compressor and condensing same;

providing an expansion device receiving refrigerant from said condenser and expanding same;

providing a coil having an inlet receiving refrigerant from said expansion device and having an outlet delivering refrigerant to said compressor;

circulating refrigerant from said compressor to said condenser to said expansion device to said coil and back to said compressor in a refrigeration cycle;

directing air flow along a first set of coil sections and giving up heat to refrigerant in said first set of coil sections to evaporate refrigerant in said first set of coil sections, and then directing said air flow along a second set of coil sections absorbing heat from refrigerant in said second set of coil sections to condense refrigerant in said second set of coil sections.

3. The invention according to claim 2 wherein said outlet of said coil has a lower temperature than said inlet of said coil.

4. A method for efficiently dehumidifying air comprising:

providing a compressor for delivering hot compressed refrigerant;

providing a condenser receiving refrigerant from said compressor and condensing same;

providing an expansion device receiving refrigerant from said condenser and expanding same;

providing a coil having an inlet receiving refrigerant from said expansion device and having an outlet delivering refrigerant to said compressor;

circulating refrigerant from said compressor to said condenser to said expansion device to said coil and back to said compressor in a refrigeration cycle;

alternately evaporating and condensing refrigerant in said coil;

directing air flow along evaporating sections of said coil and then along condensing sections of said coil.

5. The invention according to claim 4 comprising differentially evaporating and condensing refrigerant in said coil such that less refrigerant is condensed in the condensing coil sections than is evaporated in the evaporating coil sections, such that said coil outlet has a higher percentage gas refrigerant than said coil inlet, and such that said coil outlet has a lower percentage liquid refrigerant than said coil inlet, and such that said coil outlet has a lower temperature than said coil inlet.

6. A method for efficiently dehumidifying air comprising:

providing a compressor for delivering hot compressed refrigerant;

providing a condenser receiving refrigerant from said compressor and condensing same;

providing an expansion device receiving refrigerant from said condenser and expanding same;

providing a coil having a plurality of serially connected coil sections comprising first and second sets;

circulating refrigerant from said compressor to said condenser to said expansion device to said coil and back to said compressor in a refrigeration cycle, said coil having an inlet receiving refrigerant from said expansion device and having an outlet delivering refrigerant to said compressor, said outlet of said coil being of lower temperature than said inlet of said coil;

circulating refrigerant through said serially connected coil sections by circulating refrigerant through the first coil section of said first set, then through the first coil section of said second set, then through the second coil section of said first set, then through the second coil section of said second set, and so on;

directing air flow in a path having first and second legs extending along said coil, by directing air flow along said first leg of said path along said first set of coil sections, and then directing air flow along said second leg of said path along said second set of coil sections;

transferring heat from air flowing along said first leg of said path to refrigerant in said first set of coil sections such that said refrigerant absorbs heat from the air and evaporates to lower the temperature of the air below its dew point such that water vapor in the air is condensed to liquid to dehumidify the air;

circulating refrigerant from said first set of coil sections to said second set of coil sections by circulating refrigerant from a coil section of said first set to the next serially connected respective coil section of said second set;

transferring heat from said refrigerant in said second set of coil sections to air flowing along said second leg of said path such that heat is given up to the air and the refrigerant condenses, to raise the temperature of the air such that dehumidified and warmed air flows from said second leg of said path, such that heat is transferred from air flow along said first leg of said path to air flow along said second leg of said path through the media of said refrigerant, to put heat back into the air flow along said second leg of said path from the air flow along said first leg of said path, reducing the net cooling effect of said coil, to reduce the net load on said compressor by said coil such that said compressor will consume power based on the net cooling load while said coil provides the greater cooling capacity of said first set of coil sections, which allows more moisture to be condensed from the air with less energy.

7. The invention according to claim 6 comprising:

directing air flow along said first leg of said path by directing air flow across said first coil section of said first set, then across said second coil section of said first set, and so on until air flow crosses the last coil section of said first set;

then directing air flow along said second leg of said path by directing air flow across the last coil section of said second set, and then across the next to last coil section of said second set, and so on until air flow crosses said first coil section of said second set, such that air flow along said path is initially directed across said first coil section of said first set, and is lastly directed across said first coil section of said second set.

8. The invention according to claim 7 wherein said coil inlet is said first coil section of said first set.

9. The invention according to claim 8 wherein said coil outlet is said last coil section of said second set.

10. The invention according to claim 8 wherein said coil outlet is said last coil section of said first set.

11. A method for efficiently dehumidifying air comprising:

providing a compressor for delivering hot compressed refrigerant;

providing a condenser receiving refrigerant from said compressor and condensing same;

providing an expansion device receiving refrigerant from said condenser and expanding same;

providing a coil having an inlet receiving refrigerant from said expansion device and having an outlet delivering refrigerant to said compressor;

circulating refrigerant from said compressor to said condenser to said expansion device to said coil and back to said compressor in a refrigeration cycle, said coil outlet being of lower temperature than said coil inlet;

directing air flow in a straight-through path having first and second legs extending along said coil, directing air flow along said first leg of said path along a first portion of said coil toward said coil outlet to lower the temperature of the air below its dew point such that water vapor in the air is condensed to liquid to dehumidify the air, then directing air flow along said second leg of said path along a second portion of said coil away from said coil outlet to raise the temperature of the air such that dehumidified and warmed air flows from said second leg of said path at said second portion of said coil;

transferring heat from air flowing along said first leg of said path to refrigerant in said first portion of said coil;

circulating refrigerant from said first portion of said coil to said second portion of said coil;

transferring heat from said refrigerant in said second portion of said coil to air flowing along said second leg of said path, such that heat is transferred from air flow along said first leg of said path to air flow along said second leg of said path through the media of said refrigerant, to put heat back into the air flow along said second leg of said path from the air flow along said first leg of said path, reducing the net cooling effect of said coil, to reduce the net load on said compressor by said coil such that said compressor will consume power based on the net cooling load, while said coil provides the greater cooling capacity of said first portion, which allows more moisture to be condensed from the air with less energy.

12. The invention according to claim 11 comprising:

circulating refrigerant through said coil in a path having multiple parallel runs interconnected at their ends such that the outermost run on one side of the coil is connected to the outermost run on the other side of the coil, and the next to outermost run on the one side of the coil is connected to the next to outermost run on the other side of the coil, and so on, one of said outermost runs providing said coil inlet, a central run providing said coil outlet;

directing air flow along said first leg of said path along said first portion of said coil from one of said outermost runs to said central run;

directing air flow along said second leg of said path along said second portion of said coil from said central run to the other of said outermost runs.

13. The invention according to claim 12 comprising directing air flow along said first and second legs rectilinearly aligned with each other and perpendicular to said runs.

14. The invention according to claim 13 comprising providing a plurality of further expansion devices in said coil along the length thereof between said coil inlet and said coil outlet progressively expanding the refrigerant and progressively reducing refrigerant temperature.

15. The invention according to claim 11 comprising directing said dehumidified and warmed air from said second leg of said path at said second portion of said coil through said condenser.

16. A method for efficiently dehumidifying air comprising:

providing a compressor for delivering hot compressed refrigerant;

providing a condenser receiving refrigerant from said compressor and condensing same;

providing an expansion device receiving refrigerant from said condenser and expanding same;

providing a coil having an inlet receiving refrigerant from said expansion device and having an outlet delivering refrigerant to said compressor;

circulating refrigerant from said compressor to said condenser to said expansion device to said coil and back to said compressor in a refrigeration cycle, said coil outlet being of lower temperature than said coil inlet;

directing air flow in a loop-back path having first and second legs extending along said coil, by directing air flow along said first leg of said path along a first portion of said coil in a first direction from said coil inlet toward said coil outlet to lower the temperature of the air below its dew point such that water vapor in the air is condensed to liquid to dehumidify the air, then reversing the air flow from said first direction at said coil outlet, then directing the air flow along said second leg of said path along a second portion of said coil in a second direction from said coil outlet toward said coil inlet to raise the temperature of the air such that dehumidified and warmed air flows from said second leg of said path at said second portion of said coil;

transferring heat from air flowing along said first leg of said path to refrigerant in said first portion of said coil;

circulating refrigerant from said first portion of said coil to said second portion of said coil;

transferring heat from said refrigerant in said second portion of said coil to air flowing along said second leg of said path, such that heat is transferred from air flow along said first leg of said path to air flow along said second leg of said path through the media of said refrigerant, to put heat back into the air flow along said second leg of said path from the air flow along said first leg of said path, reducing the net cooling effect of said coil, to reduce the net load on said compressor by said coil such that said compressor will consume power based on the net cooling load, while said coil provides the greater cooling capacity of said first portion, which allows more moisture to be condensed from the air with less energy.

17. The invention according to claim 16 comprising:

circulating said refrigerant through said coil in a serpentine path having multiple straight runs and having at the end of each run a reverse bend leading the to next run;

directing air flow along said first leg of said path along a first portion of each said run in said first direction;

directing air flow along said second leg of said path along a second portion of each said run in a second direction.

18. The invention according to claim 17 comprising reversing air flow at said coil outlet by directing air flow along a U-shape bend from said first direction to said second direction, and wherein said air flow path, including said first and second legs and said U-shape bend, and each said run of said coil are all coplanar.

19. The invention according to claim 18 comprising directing air flow along said first and second legs parallel to each other and perpendicular to each of said runs.

20. The invention according to claim 19 comprising providing a plurality of expansion devices in said coil along the length of said serpentine path progressively expanding the refrigerant and progressively reducing refrigerant temperature.

21. The invention according to claim 16 comprising directing said dehumidified and warmed air from said second leg of said path at said second portion of said coil through said condenser.

22. A method for air conditioning and efficiently dehumidifying an enclosed space, comprising:

providing a compressor for delivering hot compressed refrigerant;

providing a condenser receiving refrigerant from said compressor and condensing same;

providing an expansion device receiving refrigerant from said condenser and expanding same;

providing a coil having an inlet receiving refrigerant from said expansion device and having an outlet delivering refrigerant to said compressor;

circulating refrigerant from said compressor to said condenser to said expansion device to said coil and back to said compressor in a refrigeration cycle, said condenser being exterior to said space and exhausting heat given up by said refrigerant during condensing thereof, said coil being within said space for cooling said space, said coil outlet being of lower temperature than said coil inlet;

directing air flow along said coil to cool said space by directing air flow in a path having first and second legs extending along said coil, by directing air flow along said first leg of said path along a first portion of said coil from said coil inlet toward said coil outlet to lower the temperature of the air below its dew point such that water vapor in the air is condensed to liquid to dehumidify the air, then directing the air flow along said second leg of said path along a second portion of said coil from said coil outlet toward said coil inlet such that dehumidified air flows from said second leg of said path at said second portion of said coil at a temperature greater than the temperature of the air at said coil outlet and less than the temperature of air exterior to said space;

transferring heat from air flowing along said first leg of said path to refrigerant in said first portion of said coil;

circulating refrigerant from said first portion of said coil to said second portion of said coil;

transferring heat from said refrigerant in said second portion of said coil to air flowing along said second leg of said path, such that heat is transferred from air flow along said first leg of said path to air flow along said second leg of said path through the media of said refrigerant, to put heat back into the air flow along said second leg of said path from the air flow along said first leg of said path, reducing the net cooling effect of said coil, to reduce the net load on said compressor by said coil such that said compressor will consume power based on the net cooling load, while said coil provides the greater cooling capacity of said first portion, which allows more moisture to be condensed from the air with less energy.

23. A dehumidifier comprising:

a compressor for delivering hot compressed refrigerant;

a condenser receiving refrigerant from said compressor and condensing same;

an expansion device receiving refrigerant from said condenser and expanding same;

a coil having an inlet receiving refrigerant from said expansion device and having an outlet delivering refrigerant to said compressor, said refrigerant being circulated from said compressor to said condenser to said expansion device to said coil and back to said compressor in a refrigeration cycle, said coil outlet being of lower temperature than said coil inlet;

means directing air flow through said coil to cool the air below its dew point such that water vapor in the air is condensed to liquid to dehumidify the air, said air flow then being directed through the coil to heat the air to a temperature below the incoming air to the coil and above the dew point of the air, such that the coil presents a net cooling load on the compressor represented by the enthalpy difference in air entering and leaving the coil, such that the air entering the coil is cooled down below the dew point and then reheated before leaving the coil, such that the air leaving the coil has a lower temperature than the air entering the coil, and such that the air leaving the coil is dehumidified relative to the air entering the coil.

24. A dehumidifier comprising:

a compressor for delivering hot compressed refrigerant;

a condenser receiving refrigerant from said compressor and condensing same;

an expansion device receiving refrigerant from said condenser and expanding same;

a coil having an inlet receiving refrigerant from said expansion device and having an outlet delivering refrigerant to said compressor, said refrigerant being circulated from said compressor to said condenser to said expansion device to said coil and back to said compressor in a refrigeration cycle, said coil outlet being of lower temperature than said coil inlet, said coil having a first set of sections for evaporating refrigerant and a second set of sections for condensing refrigerant;

means directing air flow along said first set of coil sections and giving up heat to refrigerant in said first set of coil sections to evaporate refrigerant in said first set of coil sections, and then directing said air flow along said second set of coil sections absorbing heat from refrigerant in said second set of coil sections to condense refrigerant in said second set of coil sections.

25. The invention according to claim 24 wherein said coil outlet has a lower temperature than said coil inlet.

26. A dehumidifier comprising:

a compressor for delivering hot compressed refrigerant;

a condenser receiving refrigerant from said compressor and condensing same;

an expansion device receiving refrigerant from said condenser and expanding same;

a coil having an inlet receiving refrigerant from said expansion device and having an outlet delivering refrigerant to said compressor, said refrigerant being circulated from said compressor to said condenser to said expansion device to said coil and back to said compressor in a refrigeration cycle, said refrigerant being alternately evaporated and condensed in said coil;

means directing air flow along evaporating sections of said coil and then along condensing sections of said coil.

27. The invention according to claim 26 wherein said refrigerant is differentially evaporated and condensed in said coil such that less refrigerant is condensed in the condensing coil sections than is evaporated in the evaporating coil sections, such that said coil outlet has a higher percentage gas refrigerant than said coil inlet, and such that said coil outlet has a lower percentage liquid refrigerant than said coil inlet, and such that said coil outlet has a lower temperature than said coil inlet.

28. A dehumidifier comprising:

a compressor for delivering hot compressed refrigerant;

a condenser receiving refrigerant from said compressor and condensing same;

an expansion device receiving refrigerant from said condenser and expanding same;

a coil having an inlet receiving refrigerant from said expansion device and having an outlet delivering refrigerant to said compressor, said refrigerant being circulated from said compressor to said condenser to said expansion device to said coil and back to said compressor in a refrigeration cycle, said coil outlet being of lower temperature than said coil inlet, said coil having a plurality of serially connected coil sections comprising first and second sets, said refrigerant being circulated through said serially connected coil sections, said refrigerant being initially circulated through the first coil section of said first set, then through the first coil section of said second set, then through the second coil section of said first set, then through the second coil section of said second set, and so on;

means directing air flow in a path having first and second legs extending along said coil, comprising means directing air flow along said first leg of said path along said first set of coil sections, means then directing the air flow along said second leg of said path along said second set of coil sections, heat from air flowing along said first leg of said path being transferred to refrigerant in said first set of coil sections such that said refrigerant absorbs heat from the air and evaporates to lower the temperature of the air below the dew point such that water vapor in the air is condensed to liquid to dehumidify the air, said refrigerant being circulated from said first set of coil sections to said second set of coil sections by circulation of refrigerant from a coil section of said first set to the next serially connected respective coil section of said second set, heat from said refrigerant in said second set of coil sections being transferred to air flowing along said second leg of said path such that heat is given up to the air and the refrigerant condenses, to raise the temperature of the air such that dehumidified and warmed air flows from said second leg of said path, such that heat is transferred from air flow along said first leg of said path to air flow along said second leg of said path through the media of said refrigerant, to put heat back into the air flow along said second leg of said path from the air flow along said first leg of said path, reducing the net cooling effect of said coil, to reduce the net load on said compressor by said coil such that said compressor will consume power based on the net cooling load, while the coil provides the greater cooling capacity of said first set of coil sections, which allows more moisture to be condensed from the air with less energy.

29. The invention according to claim 28 wherein said coil inlet is said first coil section of one of said first and second sets.

30. The invention according to claim 28 wherein:

said means directing air flow along said first leg of said path directs air flow across said first coil section of said first set, then across said second coil section of said first set, and so on until said air flow crosses the last coil section of said first set;

said means directing air flow along said second leg of said path directs air flow across the last coil section of said second set, then across the next to last coil section of said second set, and so on until said air flow crosses said first coil section of said second set, such that air flow along said path is initially directed across said first coil of said first set, and is lastly directed across said first coil of said second set.

31. The invention according to claim 30 wherein said coil inlet is said first coil section of said first set.

32. The invention according to claim 31 wherein said coil outlet is said last coil section of said second set.

33. The invention according to claim 31 wherein said coil outlet is said last coil section of said first set.

34. A dehumidifier comprising:

a compressor for delivering hot compressed refrigerant;

a condenser receiving refrigerant from said compressor and condensing same;

an expansion device receiving refrigerant from said condenser and expanding same;

a coil having an inlet receiving refrigerant from said expansion device and having an outlet delivering refrigerant to said compressor, said refrigerant being circulated from said compressor to said condenser to said expansion device to said coil and back to said compressor in a refrigeration cycle, said coil outlet being of lower temperature than said coil inlet;

means directing air flow in a straight-through path having first and second legs extending along said coil, comprising means directing air flow along said first leg of said path along a first portion of said coil from said coil inlet toward said coil outlet to lower the temperature of the air below the dew point such that water vapor in the air is condensed to liquid to dehumidify the air, means then directing the air flow along said second leg of said path along a second portion of said coil from said coil outlet toward said coil inlet to raise the temperature of the air such that dehumidified and warmed air flows from said second leg of said path at said second portion of said coil, wherein heat is transferred from air flowing along said first leg of said path to refrigerant in said first portion of said coil, and refrigerant is circulated from said first portion of said coil to said second portion of said coil, and heat is transferred from said refrigerant in said second portion of said coil to air flowing along said second leg of said path, such that heat is transferred from air flow along said first leg of said path to air flow along said second leg of said path through the media of said refrigerant, to put heat back into the air flow along said second leg of said path from the air flow along said first leg of said path, reducing the net cooling effect of said coil, to reduce the net load on said compressor by said coil such that said compressor will consume power based on the net cooling load, while said coil provides the greater cooling capacity of said first portion, which allows more moisture to be condensed from the air with less energy.

35. The invention according to claim 34 wherein said coil has multiple parallel runs interconnected at their ends such that the outermost run on one side of the coil is connected to the outermost run on the other side of the coil, and the next to outermost run on the one side of the coil is connected to the next to outermost run on the other side of the coil, and so on, one of said outermost runs being said coil inlet, a central run being said coil outlet, and wherein said means directing air flow directs air flow along said first leg of said path along said first portion of said coil from one of said outermost runs on to said central run, and wherein said means directing air flow directs air flow along said second leg of said path along said second portion of said coil from said central run to the other of said outermost runs.

36. The invention according to claim 35 wherein said first and second legs are perpendicular to said runs.

37. The invention according to claim 36 wherein said first and second legs are rectilinearly aligned with each other.

38. The invention according to claim 36 comprising a plurality of further expansion devices in said coil along the length thereof between said coil inlet and said coil outlet progressively expanding the refrigerant and progressively reducing refrigerant temperature.

39. The invention according to claim 34 wherein said dehumidified and warmed air is directed from said second leg of said path at said second portion of said coil through said condenser.

40. A dehumidifier comprising:

a compressor for delivering hot compressed refrigerant;

a condenser receiving refrigerant from said compressor and condensing same;

an expansion device receiving refrigerant from said condenser and expanding same;

a coil having an inlet receiving refrigerant from said expansion device and having an outlet delivering refrigerant to said compressor, said refrigerant being circulated from said compressor to said condenser to said expansion device to said coil and back to said compressor in a refrigeration cycle, said coil outlet being of lower temperature than said coil inlet;

means directing air flow in a loop-back path having first and second legs extending along said coil, comprising means directing air flow along said first leg of said path along a first portion of said coil in a first direction from said coil inlet toward said coil outlet to lower the temperature of the air below the dew point such that water vapor in the air is condensed to liquid to dehumidify the air, means then reversing said air flow from said first direction at said coil outlet, means then directing said air flow along said second leg of said path along a second portion of said coil in a second direction from said coil outlet toward said coil inlet to raise the temperature of the air such that dehumidified and warmed air flows from said second leg of said path at said second portion of said coil, wherein heat is transferred from air flowing along said first leg of said path to refrigerant in said first portion of said coil, and refrigerant is circulated from said first portion of said coil to said second portion of said coil, and heat is transferred from said refrigerant in said second portion of said coil to air flowing along said second leg of said path, such that heat is transferred from air flow along said first leg of said path to air flow along said second leg of said path through the media of said refrigerant, to put heat back into the air flow along said second leg of said path from the air flow along said first leg of said path, reducing the net cooling effect of said coil, to reduce the net load on said compressor by said coil such that said compressor will consume power based on the net cooling load, while said soil provides the greater cooling capacity of said first portion, which allows more moisture to be condensed from the air with less energy.

41. The invention according to claim 40 wherein said coil has multiple parallel runs and has at the end of each run a reverse bend leading to the next run to form a serpentine path, and wherein air flow is directed along said first leg of said path along a first portion of each said run in said first direction, and wherein air flow is directed along said second leg of said path along a second portion of each said run in said second direction.

42. The invention according to claim 41 wherein air flow is reversed at said coil outlet by a U-shape bend between said first and second directions, and wherein said air flow path, including said first and second legs and said U-shape bend, and each said run of said coil are all coplanar.

43. The invention according to claim 42 wherein said first and second legs of said air flow path are parallel to each other and perpendicular to each of said runs.

44. The invention according to claim 43 comprising a plurality of further expansion devices in said coil along the length of said serpentine path progressively expanding the refrigerant and progressively reducing refrigerant temperature.

45. The invention according to claim 40 wherein dehumidified and warmed air is directed from said second leg of said path at said second portion of said coil through said condenser.

46. An air conditioner and dehumidifier for an enclosed space, comprising:

a compressor for delivering hot compressed refrigerant;

a condenser receiving refrigerant from said compressor and condensing same, said condenser being exterior to said space and exhausting heat given up by said refrigerant during condensing thereof;

an expansion device receiving refrigerant from said condenser and expanding same;

a coil having an inlet receiving refrigerant from said expansion device and having an outlet delivering refrigerant to said compressor, said refrigerant being circulated from said compressor to said condenser to said expansion device to said coil and back to said compressor in a refrigeration cycle, said coil being within said space for cooling said space, said coil outlet being of lower temperature than said coil inlet;

means directing air flow along said coil to cool said space including means directing air flow in a path having first and second legs extending along said evaporator, comprising means directing air flow along said first leg of said path along a first portion of said coil toward said coil outlet to lower the temperature of the air below the dew point such that water vapor in the air is condensed to liquid to dehumidify the air, means then directing said air flow along said second leg cf said path along a second portion of said coil away from said coil outlet such that dehumidified air flows from said second leg of said path at said second portion of said coil at a temperature greater than the temperature of the air at said coil outlet and less than the temperature of air exterior to said space, wherein heat is transferred from air flowing along said first leg of said path to refrigerant in said first portion of said coil, and refrigerant is circulated from said first portion of said coil to said second portion of said coil, and heat is transferred from said refrigerant in said second portion of said coil to air flowing along said second leg of said path, such that heat is transferred from air flow along said first leg of said path to air flow along said second leg of said path through the media of said refrigerant, to put heat back into the air flow along said second leg of said path from the air flow along said first leg of said path, reducing the net cooling effect of said coil, to reduce the net load on said compressor by said coil such that said compressor will consume power based on the net cooling load, while said coil provides the greater cooling capacity of said first portion, which allows more moisture to be condensed from the air with less energy.

* * * * *